US009200495B2

(12) United States Patent
Streater, Jr. et al.

(10) Patent No.: US 9,200,495 B2
(45) Date of Patent: Dec. 1, 2015

(54) ASSEMBLY AND METHOD FOR WIDE CATCH OVERSHOT

(71) Applicant: NATIONAL OILWELL VARCO, LP, Houston, TX (US)

(72) Inventors: James R. Streater, Jr., Humble, TX (US); Daniel Hernandez, Pasadena, TX (US); Filiberto Garcia, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 14/074,708

(22) Filed: Nov. 7, 2013

(65) Prior Publication Data

US 2014/0069649 A1 Mar. 13, 2014

Related U.S. Application Data

(63) Continuation-in-part of application No. 12/946,595, filed on Nov. 15, 2010, which is a continuation of application No. PCT/US2010/056848, filed on Nov. 16, 2010.

(60) Provisional application No. 61/261,556, filed on Nov. 16, 2009, provisional application No. 61/723,676, filed on Nov. 7, 2012.

(51) Int. Cl.
*E21B 31/18* (2006.01)

(52) U.S. Cl.
CPC ..... *E21B 31/18* (2013.01)

(58) Field of Classification Search
CPC ..... E21B 31/18; E21B 31/12; E21B 31/20
USPC ..... 166/98, 301; 294/86.1–86.34
See application file for complete search history.

(56) References Cited

U.S. PATENT DOCUMENTS

| | | | | |
|---|---|---|---|---|
| 1,687,808 | A | 10/1928 | Thomas et al. | |
| 2,174,077 | A * | 9/1939 | Bowen | 294/86.17 |
| 2,491,392 | A | 12/1949 | Osmun | |
| 2,492,813 | A * | 12/1949 | Osmun | 294/86.3 |
| 2,616,752 | A | 11/1952 | Osmun | |

(Continued)

OTHER PUBLICATIONS

International Search Report PCT/US2010/056848, mailed Jan. 14, 2011.

(Continued)

*Primary Examiner* — Blake Michener
*Assistant Examiner* — Kipp Wallace
(74) *Attorney, Agent, or Firm* — Winston & Strawn LLP

(57) ABSTRACT

A grapple for use in an overshot has a tension ring with a reduced helix diameter but the helix diameter is not reduced on either sides of the control finger slot. One embodiment includes expansion blades on the inner diameter ("ID") of the tension ring to allow the grapple to expand substantially before the fish reaches the segments. An embodiment provides for a control with an offset finger to allow the guide thread ID to be smaller than the bowl helix major ID. Also provided is grapple control for a spiral grapple that has at least one gap to allow the grapple control to be more compliant during fishing operations. The control may include one or more bridges of reduced thickness. Alternate embodiments include gaps and support bands with or without bridges and/or a backup ring to help eliminate misalignment of the grapple control with the support shoulder of the overshot guide.

9 Claims, 18 Drawing Sheets

(56) References Cited

U.S. PATENT DOCUMENTS

| | | | | | |
|---|---|---|---|---|---|
| 2,659,440 | A | | 11/1953 | Osmun | |
| 2,743,130 | A | * | 4/1956 | Osmun | 294/86.17 |
| 2,753,208 | A | | 7/1956 | Le Bus | |
| 2,945,720 | A | | 7/1960 | Osmun | |
| 2,955,868 | A | | 10/1960 | Horn | |
| 2,970,859 | A | * | 2/1961 | Justice | 294/86.17 |
| 2,973,037 | A | | 2/1961 | Kennard | |
| 3,191,981 | A | | 6/1965 | Osmun | |
| 3,727,691 | A | | 4/1973 | Muecke et al. | |
| 3,746,093 | A | | 7/1973 | Mullins | |
| 4,023,847 | A | | 5/1977 | Webb | |
| 4,157,199 | A | | 6/1979 | Klingman | |
| 5,054,832 | A | | 10/1991 | Davis et al. | |
| 5,765,638 | A | | 6/1998 | Taylor | |
| 6,425,615 | B1 | * | 7/2002 | Mullane, Jr. | 294/86.3 |
| 2008/0066914 | A1 | | 3/2008 | Fay | |
| 2011/0114317 | A1 | | 5/2011 | Streater, Jr. et al. | |

OTHER PUBLICATIONS

"Series 150 Overshots Series 150 Releasing and Circulating Overshots" Instruction Manual 1150 R3, National Oilwell, Aug. 2003, 25 pages.

Non-Final Office Action, U.S. Appl. No. 12/946,595, dated Jun. 14, 2013.

International Search Report and Written Opinion, PCT/US2013/069014, mailed Mar. 27, 2015.

* cited by examiner

ASSEMBLY AND METHOD FOR WIDE CATCH OVERSHOT

FIELD OF THE INVENTION

The present invention relates generally to overshots utilized in fishing operations and, more particularly, to modifications to grapples, controls and bowls to enable engagement of a larger range of fish.

BACKGROUND OF THE INVENTION

Currently, overshots are used to externally catch stuck fish during oil field operations. Existing overshots are designed to catch a range of fish of approximately ⅛", varying between tools of different sizes. During fishing operations, it is very common that the object the operator is trying to engage has not maintained its original outer diameter ("OD") due to wear. This unknown wear often prevents the overshot from engaging the fish on the first attempt and, therefore, can result in sometimes 2 or 3 trips downhole with smaller sized grapples to catch the fish. As a result, the cost and time of the fishing operation can be significantly increased.

In addition, problems can arise when the grapple engages larger fish. In such instances, the tension rings of the grapples can experience very large stresses at the ring concentration points which may result in the yielding of the grapple. Prior art tools that directly address the yielding of the ring due to engaging a larger range of fish are not immediately available. However, prior art tools have utilized a completely reduced OD on the grapple ring in order to reduce the stress. This feature of the prior art, however, is disadvantageous because completely reducing the ring limits the ability of the grapple to stay in contact with the control finger or other devices used to transfer torque.

Moreover, as the catch range of prior art overshots is increased, the corresponding required internal bowl dimensions require the wall thickness of the bowl to be decreased in order to allow the grapple to expand fully. Accordingly, this limits the maximum catch range of prior art overshots because the bowl wall can only be decreased so much before possible failure.

Accordingly, there is a need in the art for an overshot adapted to efficiently catch a larger range of fish, while reducing the associated stresses and retaining the integrity of the overshot.

A basic assembly for an external fishing tool includes a top sub, a bowl, a standard guide, a grapple (either a basket grapple or a spiral grapple) and grapple controls as shown in FIG. 1. A grapple control usually includes a key and grooves. In some embodiments, a groove on the outer diameter of the grapple control engages a key on the spiral grapple. During fishing operations, after engaging a fish with a spiral grapple, the spiral grapple moves down the bowl with an acceleration sometimes causing a large contact force between the grapple key and the grapple control. An excessive level of contact force may cause the system to fail. There is also need, therefore, for an overshot tool in which mechanical failure of its components, such as the grapple control, upon high contact force is eliminated or delayed.

SUMMARY OF THE INVENTION

The present invention provides methods and assemblies for modifying an overshot to enable it to catch a larger range of fish. In a first exemplary embodiment, the present invention allows the stresses in the tension ring of a basket grapple to be reduced, prevents the grapple segments from fracturing, and reduces the force necessary to expand the grapple. This is achieved, in part, by reducing down the diameter of the helix on the tension ring, thereby allowing the grapple to experience less stress as it expands. However, the helix diameter on either side of the control finger slot is not reduced in order to allow the grapple to remain in contact with the control finger despite the much increased diametrical clearance between the grapple and bowl of the increased catch range overshot of the present invention. In the alternative, the entire helix diameter may be reduced and a composite helix member may be placed along both sides of the control finger slot in order to allow the grapple to remain in contact with the control finger slot during use. Accordingly, through the use of the reduced helix diameter along the tension ring, the present invention greatly reduce the stress that the ring will experience, while still allowing torque transfer so that the grapple will engage the fish in one run.

In a second exemplary embodiment, the present invention comprises expansion blades on the inner diameter ("ID") of the tension ring which allow the grapple to expand substantially before the fish reaches the grapple segments behind the flex holes. Therefore, the cantilever effect and corresponding high stresses experienced in prior art basket grapples with smooth counterbored IDs are greatly reduced. In this embodiment, the force required to expand the grapple is applied to the blades to expand the tension ring with direct force. When the fish passes beyond the flex holes behind the segments, the grapple is much closer to the ID of the bowl, which greatly reduces the amount of cantilever deflection in the segment created before the bowl can support the grapple. In addition, the stresses in the tension ring are also reduced through grooves created as the blades are formed.

In a third exemplary embodiment, the present invention provides methods and assemblies providing a control with an offset finger for a wide catch overshot. The offset finger allows the overshot to have guide threads on the lower end of the bowl that are smaller in diameter than would otherwise be possible with prior art controls in which the finger is flush with the OD of the control. In this embodiment, the bowl threads have a single groove machined through the entire length of the threads to allow passage of the offset finger on the control during assembly. The offset finger allows the control to have a complete or partial ring and be inserted into a bowl with an ID where the use of a prior art control would not be possible. A complete or partial ring for the control of the present invention allows it to remain in position with the bowl during operations and is less likely to lose contact with the grapple. In addition, the control finger may be comprised of one solid piece or composite pieces.

In a fourth exemplary embodiment, the present invention provides methods and assemblies for a spiral grapple for use in a wide catch overshot. The grapple comprises one or more grooves along its axis which reduce stress as the grapple expands. The grooves may be cut in a direction along the axis of the grapple or may be cut at angles. The wickers may comprise chamfered edges to combat biting as the grapple is rotated along the fish. In addition, the control utilized with the spiral grapple also comprises an offset finger.

In further exemplary embodiments, the present invention provides assemblies and methods comprising a modified, compliant grapple control. A compliant grapple control allows it to withstand higher levels of contact forces during fishing operations and, therefore, reduces or eliminates equipment failure.

In an exemplary embodiment, the present invention also provides for assemblies and methods that allow the reduced failure of the grapple, its control, or the key by including a gap in the grapple control to make it more compliant and to reduce the contact force between the key of the grapple and the grapple control. The gap maybe of varying width and angle relative to the axis and outer diameter surface of the grapple control.

In another exemplary embodiment, the present invention provides assemblies and methods having a grapple control with a gap and a bridge that is sized to reduce the stress level in the grapple control a the gap closes. The bridge may be of varying thickness and may span an arc of varying sizes. It may be located diametrically opposite of the gap. In some embodiments, the grapple control comprises multiple bridges.

In further exemplary embodiments, the present invention provides for assemblies with grapple controls that comprise two or more gaps and support bands with or without bridges.

In additional exemplary embodiments, the assemblies according to the present invention include a grapple control with a backup ring between the grapple control and the guide of the overcatch tool. The backup ring helps eliminate misalignment of the grapple control with the support shoulder of the guide. The contact plane between the backup ring and the grapple control may be angled. In further embodiments, a contact surface between the backup ring and the grapple control comprises a plurality of segments at different angles. That is the grapple control (or the backup ring) may comprise at least two segments that have contact with the backup ring (or with the grapple control respectively) at different angles.

The present invention provides for a fishing method comprising engaging a fish into a spiral grapple, allowing the spiral grapple to move down a bowl, transmitting torque between the spiral grapple and the bowl using a grapple control, and deforming the grapple control with the spiral grapple.

BRIEF DESCRIPTION OF THE DRAWINGS

The present disclosure is best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DESCRIPTION OF ILLUSTRATIVE EMBODIMENTS

Illustrative embodiments of the invention are described below as they might be employed to provide a more efficient and cost-effective fishing operation. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Figure 1:
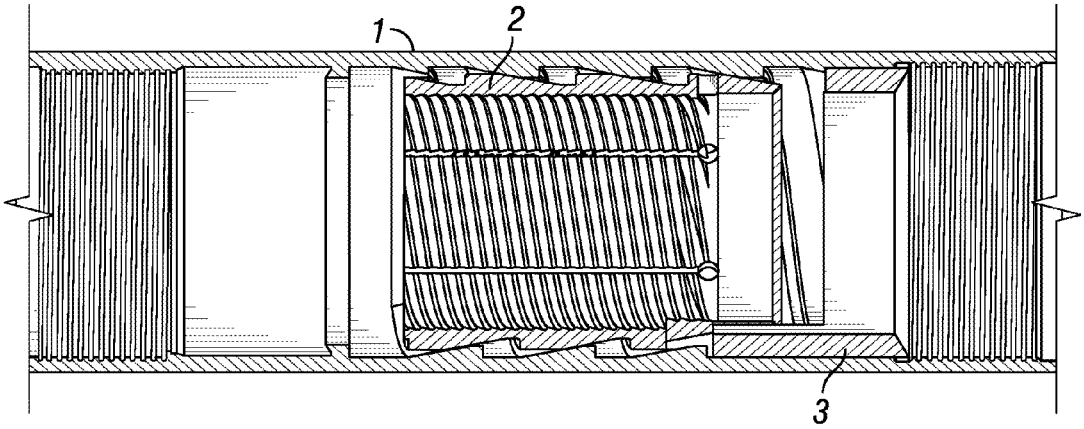
FIG. 1 (Prior Art)
FIG. 1 illustrates an overshot according to the prior art.
Figure 2:
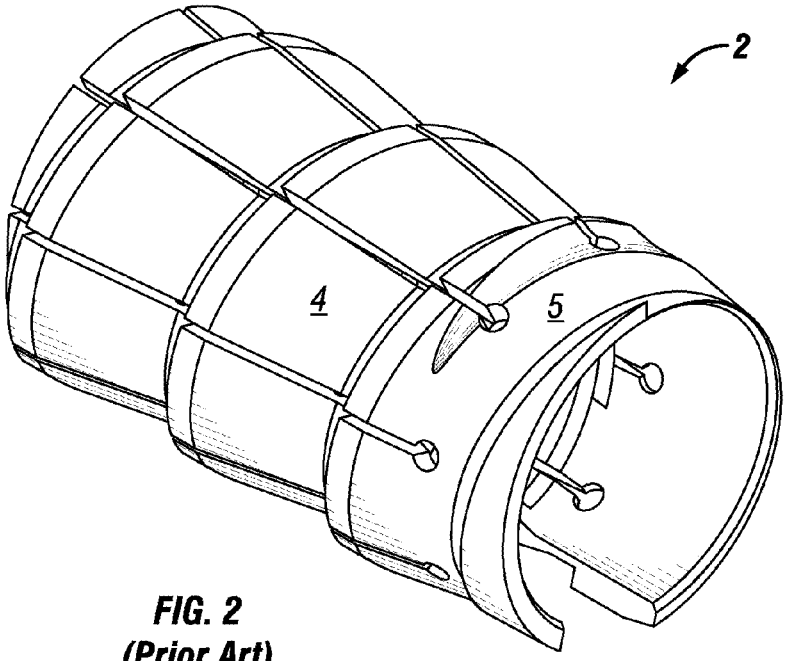
FIG. 2 (Prior Art)
FIG. 2 illustrates a basket grapple according to the prior art.

FIGS. 1 and 2 illustrate a prior art overshot and basket grapple, respectively. The basic design of an overshot consists of a bowl 1, a grapple 2, a control 3, and guide (not shown). The grapple operates such that as the fish enters the grapple from the bottom, the grapple expands until the fish has passed the inner wickers of the grapple. Referring to the grapple of FIG. 2, as the outside bowl is lifted up, the helix on the outside of the segments 4 of the grapple 2 comes into contact with the helix on the inside of the bowl. When an upward pull is exerted in the overshot, the grapple contracts around the fish. Due to wickers that are machined on the ID of the grapple, the grapple effectively engages the fish. Each grapple has a maximum and minimum catch size that it can attain. In the prior art, for example, that range can be 1/32" over and 3/32" under the nominal size. The effective total range is therefore 1/8". For embodiments of the present invention, however, the total range could be 1/4", 5/16", 3/8", 1/2", or greater depending on the tool size. Those ordinarily skilled in the art having the benefit of this disclosure realize the features of the present invention described herein may be modified to fit a variety of tools.

Because the grapple of the present invention must cover a variety of ranges, it must be sized for the minimum size, but still be able to expand to catch the maximum size. This requires that the tension ring 5 be capable of expanding for the full range of the grapple 2. This expansion can cause the tension ring 5 to deform due to stress concentration points. In order to correct this problem, an exemplary embodiment of the present invention is provided in FIGS. 3A & 3B. Here, the helix diameter 11 of tension ring 5 is turned down, i.e., reduced, to the minimum helix diameter, except for the portions of the helix diameter adjacent both sides of the control finger slot 9. As understood in the art, the "helix diameter" is the diameter of the helix on the OD of the grapple. As also understood in the art, the minimum helix diameter is the smallest possible helix diameter the grapple can have.

Figure 3A:
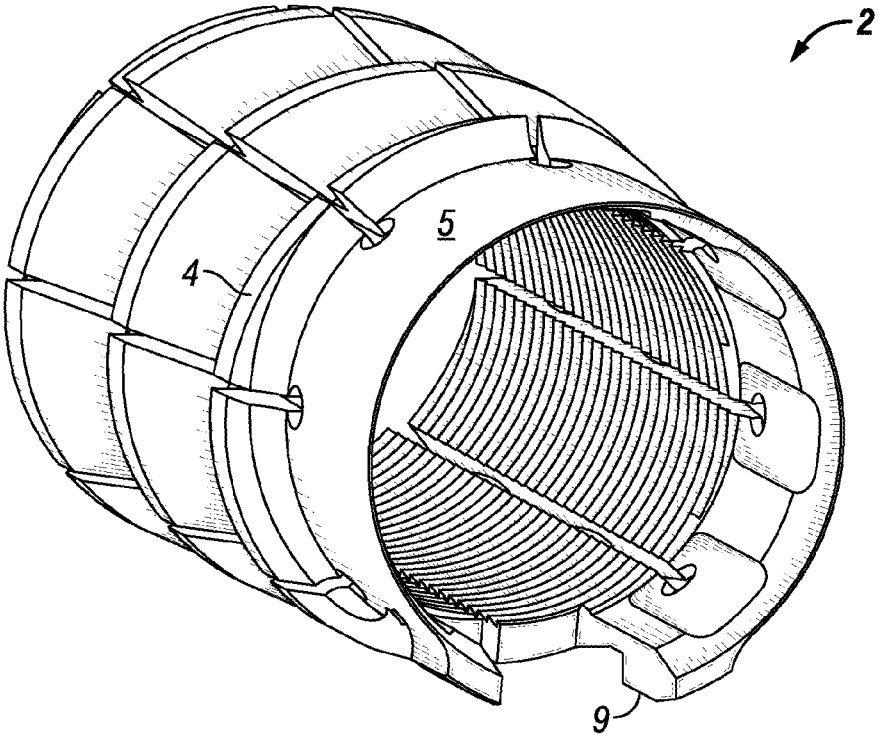
FIGS. 3A & 3B illustrate a perspective and bottom side view, respectively, of a grapple having a reduced helix diameter according to an exemplary embodiment of the present invention.
Figure 3B:
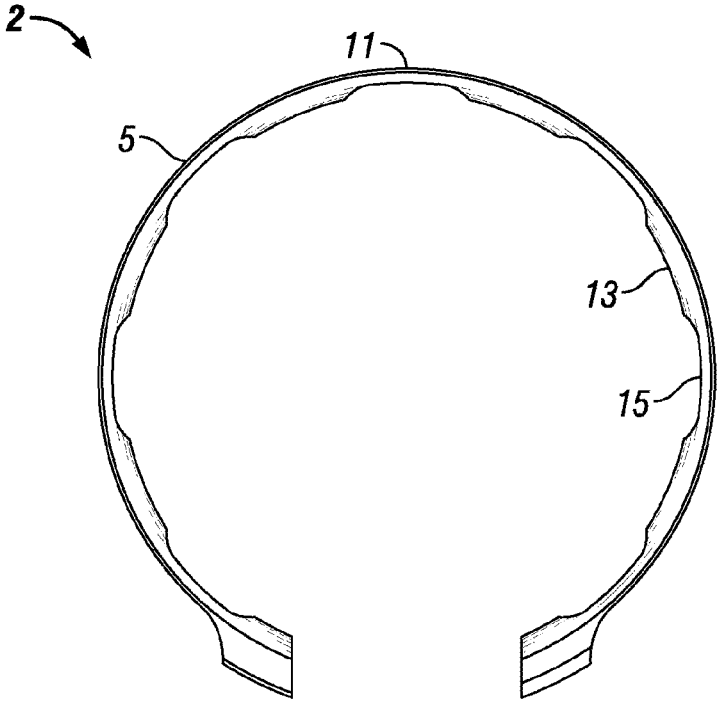

Further referring to FIGS. 3A and 3B, portions of helix diameter 11 adjacent control finger slot 9 are larger in relation to the remaining portions of helix diameter 11. In this exemplary embodiment, the largest OD of the helix diameter 11 is the major OD, while the smallest OD of helix diameter 11 is the minor or minimum OD. However, this may vary by tool. Removal of a portion of helix diameter 11 along tension ring 5 reduces the amount of force, and associated stresses, required to open grapple 2. Although portions of helix diameter 11 are illustrated as completely reduced in FIGS. 3A & 3B, those ordinarily skilled in the art having the benefit of this disclosure realize portions of helix diameter 11 could instead be partially reduced. Moreover, removal of the helix diameter may be accomplished via any method known in the art such as, for example, milling or machining.

Figure 4:
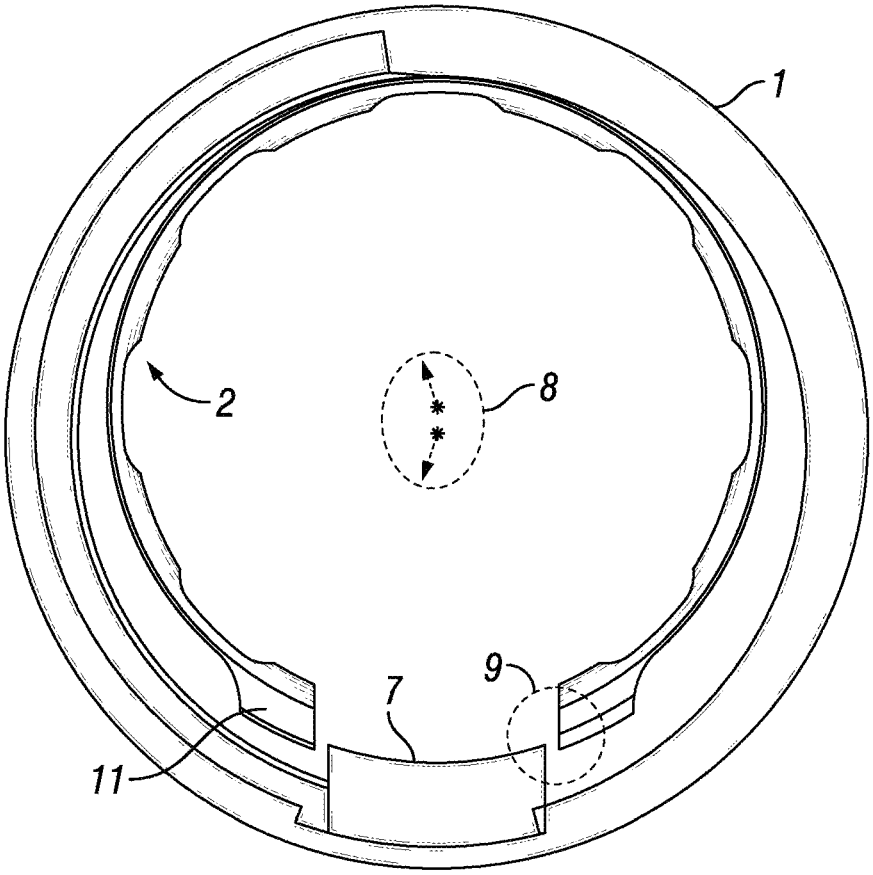
FIG. 4 illustrates an overshot according to an exemplary embodiment of the present invention.

Referring to the exemplary embodiments of FIGS. 3A, 3B and 4, utilizing the present invention results in the diametrical clearance between the bowl 1 and grapple 2 being significantly increased, as illustrated in FIG. 4. As a result, the grapple must expand more in the bowl and thus is more capable of losing contact with the control finger 7. This is very apparent when the grapple 2 is pushed to the opposite side of the bowl 1 or if the axis of symmetry for the bowl 1 and grapple 2 are displaced 8, as illustrated in FIG. 4. In order to correct this, the helix diameter 11 must remain on both sides of control finger slot 9. By allowing the helix diameter 11 to remain at finger slot 9, it is possible to get the flexibility of the thinner ring but still stay in contact with the control finger at all times. This feature is an advancement over the prior art because the catch range of a prior art grapple is limited since the grapple must remain in contact with the control finger.

Figure 5:
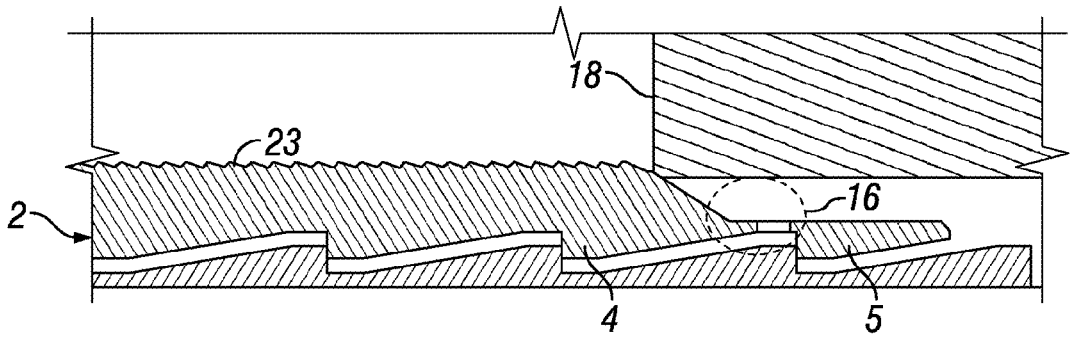
FIG. 5 (Prior Art)
FIGS. 5 and 6 illustrate views of a basket grapple stress points according to the prior art.
Figure 6:
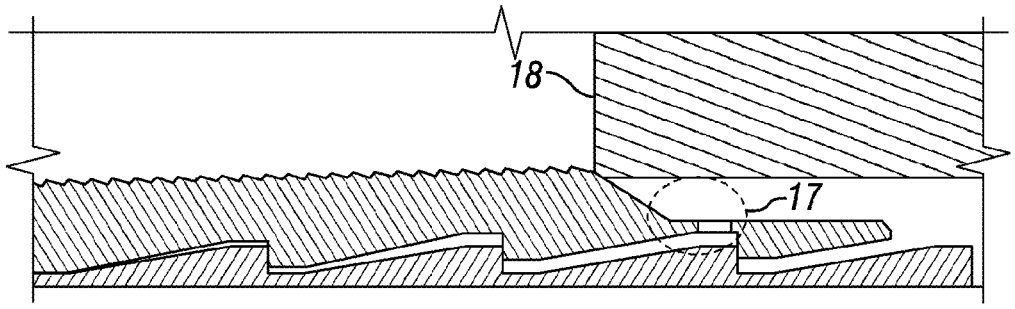
FIG. 6 (Prior Art)

FIGS. 5 and 6 illustrate the bending forces associated with the prior art grapples. As the fish 18 enters the grapple 2 and comes into contact with the wickers 23, a large bending moment 16 is placed on the grapple segments 4. When this occurs, the tension ring 5 must expand the full range. Because a majority of the force used to expand the fish is placed on the segments 4, they are very susceptible to yielding and cracking at the points 17 in FIG. 6. Therefore, by utilizing the helix diameter 11 of the present invention, such stress points can be alleviated, and one receives the flexibility of the thinner ring while retaining contact with the control finger at all times.

FIGS. 3A & 3B further illustrate an exemplary embodiment of the present invention whereby expansion blades 13 are utilized to allow the ability to catch larger size fish. Stress relieving grooves 15 are placed between expansion blades 13 in order to further relive stress during expansion. Grooves 15 are created by removing material from blades 13 by any method known in the art. In order to reduce the amount of force being applied to the segments 4, multiple expansion blades 13 are added to the ID of the tension ring 5. Those ordinarily skilled in the art having the benefit of this disclosure realize the thickness of blades 13 and the depth of grooves 15 can be varied as desired.

Figure 7:
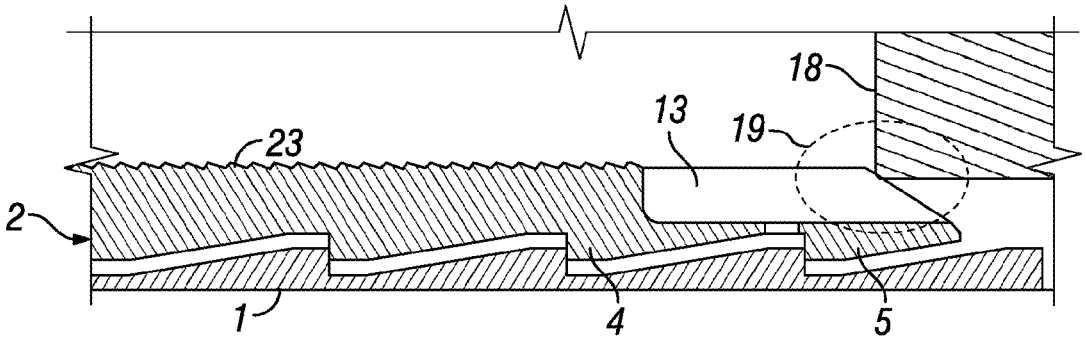
FIGS. 7-9 illustrate embodiments of the present invention whereby stress points are reduced.
Figure 8:
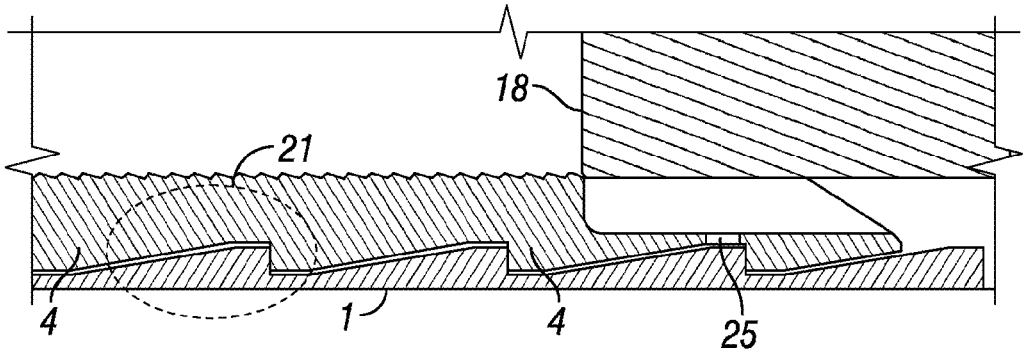
Figure 9:
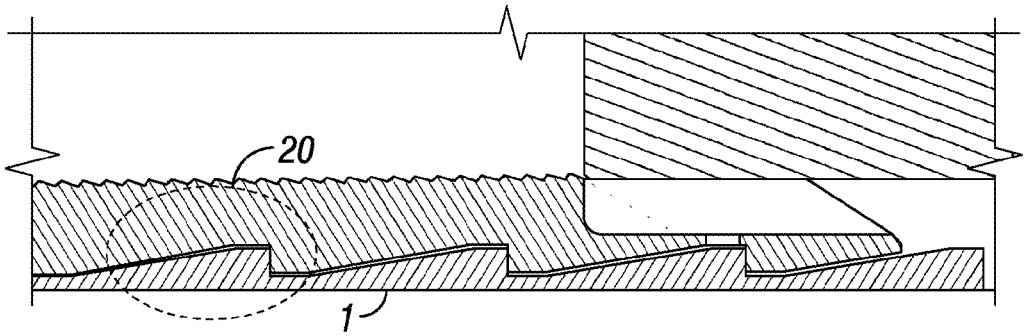

FIGS. 7-9 illustrate the grapple of the present invention and its effectiveness in reducing the stresses exhibited by the prior art design. As the fish 18 enters the grapple 2 and comes into contact with the blades 13, the grapple 2 partially expands 19. This initial expansion 19 would cause the grapple segments 4 to expand and decrease the amount of space between the grapple and the ID of the bowl 1. As the fish continues into the grapple 2, the segments 4 have to expand less due to the majority of the expansion occurring in the blade area (60-80% for example), while the segments 4 gain support from the bowl wall (as illustrated by "20" in FIG. 9). Because there is less space for the segments 4 to flare out (as illustrated by "21" in FIG. 8), they are less susceptible to bending and fracturing. Accordingly, the entire grapple of the present invention expands much more than the prior art tool (in which all expansion occurs with the fish in contact with the segments). In the present invention, however, 60%-80% of the expansion occurs before the fish contacts the segments.

Further referring to FIGS. 7-9, expansion blades 13 allow grapple 2 to expand substantially before the fish 18 reaches grapple segments 4 behind the flex holes 25. Thus, the cantilever effect and corresponding high stresses experienced in prior art basket grapples are greatly reduced. In addition, the force required to expand the grapple 4 is applied to blades 13 to expand the tension ring 5 with direct force. When the fish 18 passes beyond the flex holes 25, as illustrated in FIGS. 8-9, grapple 2 is much closer to the ID of the bowl 1 than the prior art grapple (FIGS. 5-6), thereby greatly reducing the amount of cantilever deflection in the segment 4 created before the bowl 1 can support the grapple 2.

Figure 10A:
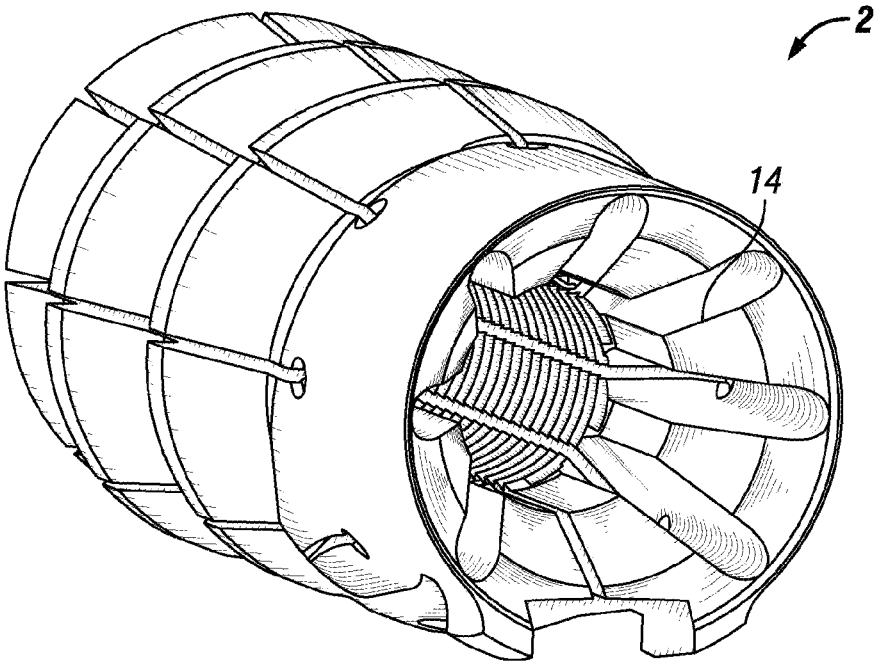
FIGS. 10A & 10B illustrate a perspective and bottom side view, respectively, of a grapple having large expansion blades according to an exemplary embodiment of the present invention.
Figure 10B:
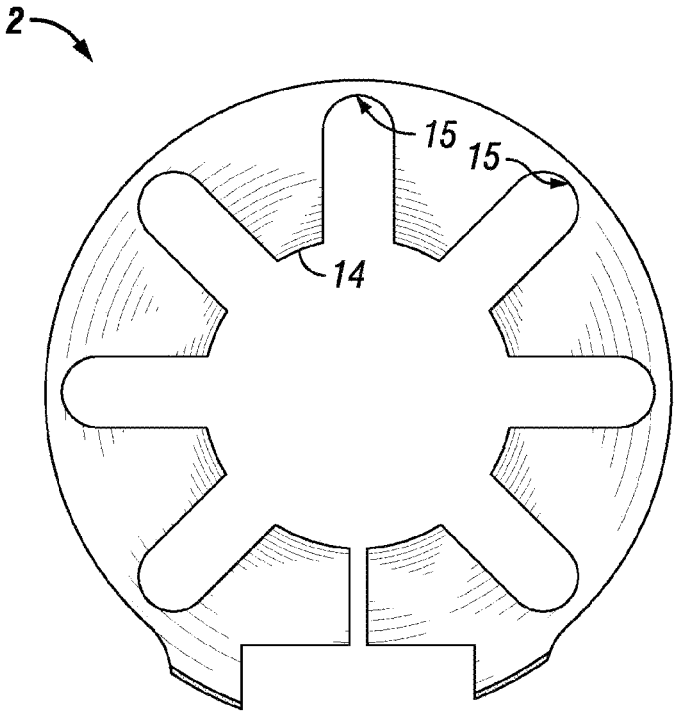
Figure 20:
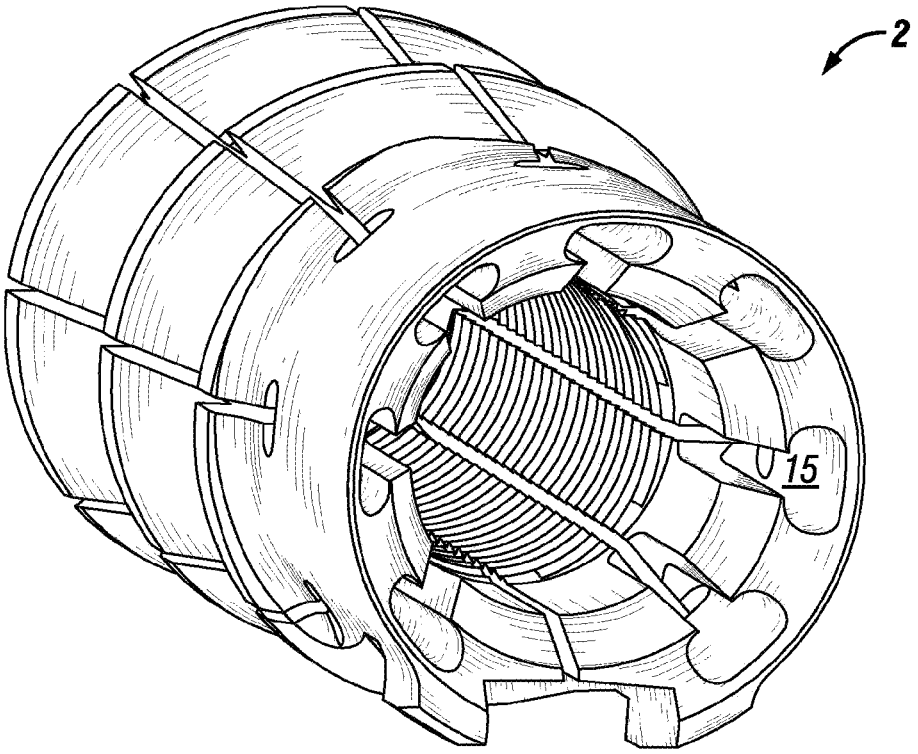
FIG. 20 illustrates an alternate exemplary embodiment of stress relieving grooves according to the present invention.
Figure 21:
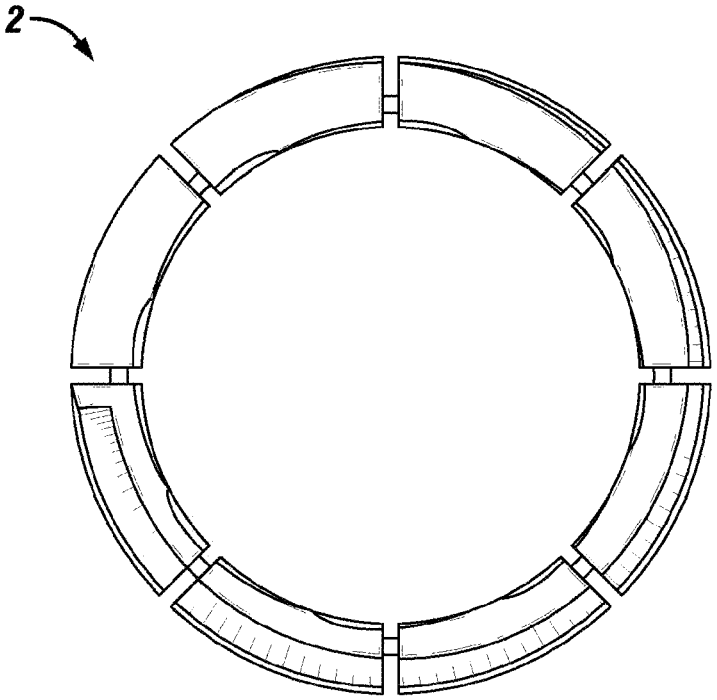
FIG. 21 illustrates a modified version of the saw cuts between the blades according to exemplary embodiments of the present invention.

FIGS. 10A & 10B display an alternative exemplary embodiment having larger expansion blades 14 with much deeper stress relieving grooves 15 due to a smaller nominal catch size. Those ordinarily skilled in the art having the benefit of this disclosure realize the depth of grooves 15, as well as the number of blades 13,14, may be varied as required by design constraints. FIG. 20 illustrates an exemplary alternate embodiment of stress relieving grooves 15. FIG. 21 illustrates a modified version of the blades having eight saw cuts, each at a 45° angle. Those ordinarily skilled in the art having the benefit of this disclosure realize more or less saw cuts may be utilized having varying degrees dependent upon design constraints.

Figure 11:
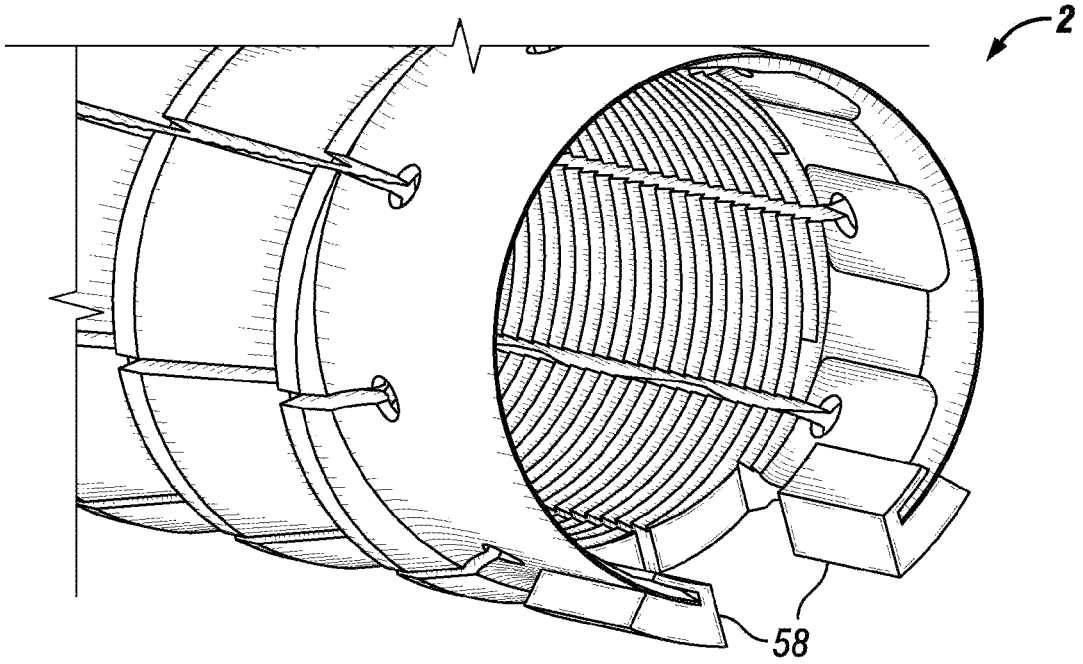
FIGS. 11-12 illustrate views of a composite helix member according to an exemplary embodiment of the present invention.
Figure 12:
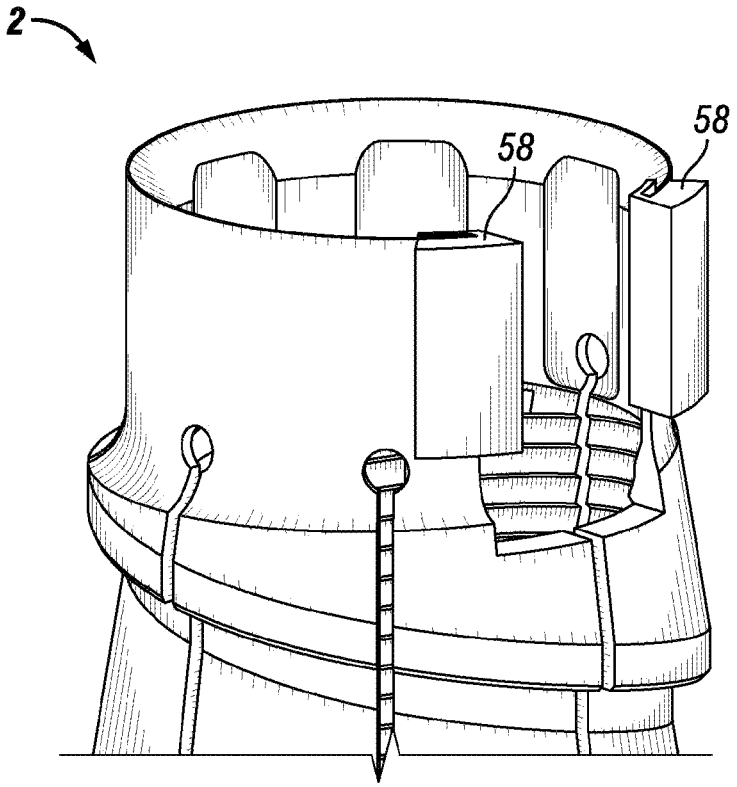

In addition to the milling that can be done to the grapple OD to reduce stress and keep it in contact with the control at all times, a composite helix member 58, such as an optional retainer cap, can be inserted on a completely turned down OD that can serve the same purpose, as illustrated in the exemplary embodiment of FIGS. 11-12. This design allows the OD of the tension ring to be completely turned down, thus minimizing the cost of an extra milling procedure. In order to keep the grapple in contact with the control, composite helix member 58 is placed on the grapple which will effectively act as the helix on both sides of the control slot as described in previous embodiments.

Figure 13:
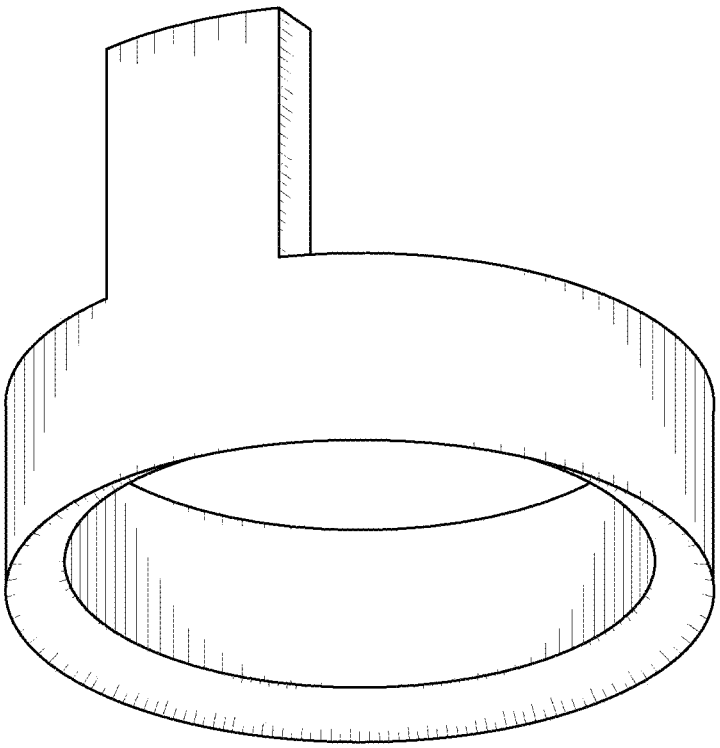
FIG. 13 (Prior Art)
FIG. 13 illustrates a control finger according to the prior art.

Exemplary embodiments of the present invention utilizing an offset control finger will now be described. Referring back to the prior art overshot illustrated in FIG. 1, the basic design consists of a bowl 1, grapple 2, control 3, and guide (not shown). Prior art control fingers (example illustrated in FIG. 13) are available for either basket grapples or spiral grapples, and are called spiral grapple controls and basket grapple controls. Cutting teeth can also be incorporated into the basket control so that it can be used to dress the top of the fish to ease the engaging process. These controls are known as basket mill controls. For the prior art, the grapples can catch a minimum and maximum range. In most cases that range would be 1/32" over and 3/32" under the nominal size which would give an effective total range of approximately 1/8".

However, by designing a wide catch overshot as described in the present invention, the total catch range is significantly increased as previously described. In order to increase the catch range, the grapple must be sized for the minimum size OD, while still able to expand to catch the maximum size OD. This also requires that the bowl be modified accordingly for the grapple. As a result, the bowl ID of the present invention is significantly increased, thereby greatly decreasing the amount of material that is available to machine threads. In order to have a full control for a standard overshot, the control OD is less than the ID of the threads to allow it to be passed through, so the finger can be inserted into the slot on the bowl.

Figure 14:
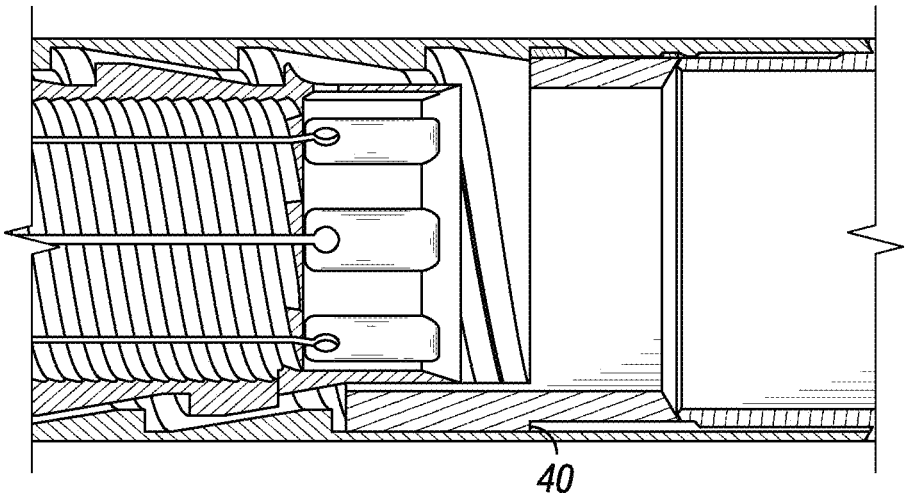
FIGS. 14-15 illustrate exemplary embodiments of an offset control finger according to the present invention.
Figure 15:
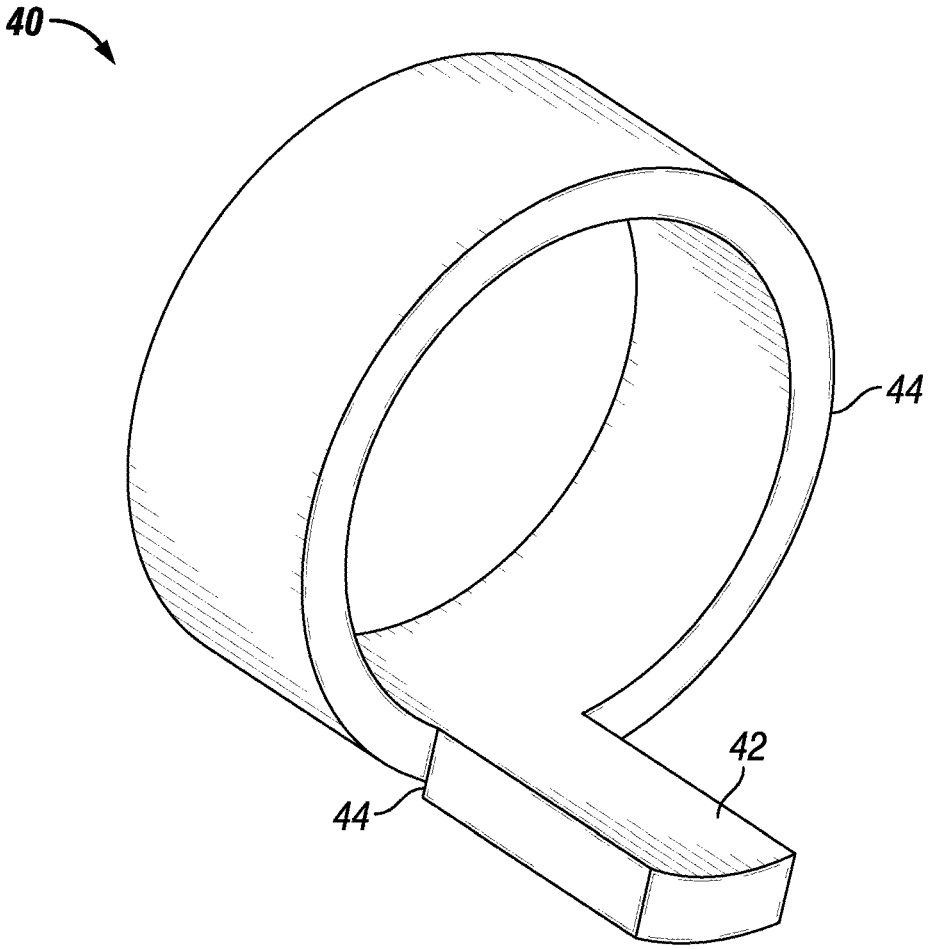
Figure 16:
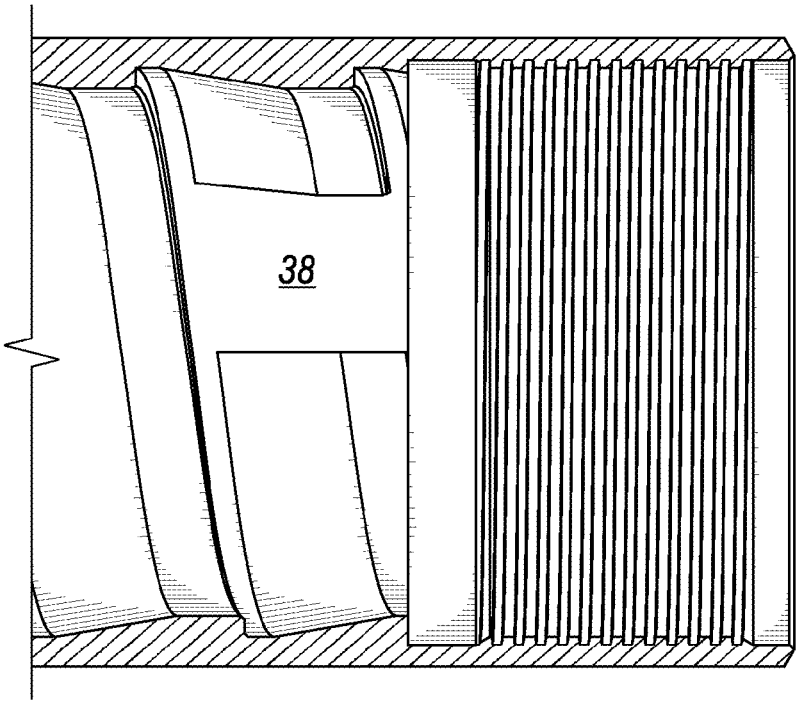
FIG. 16 (Prior Art)
FIG. 16 illustrates a bowl having a slot machine through the helix according to the prior art.
Figure 17:
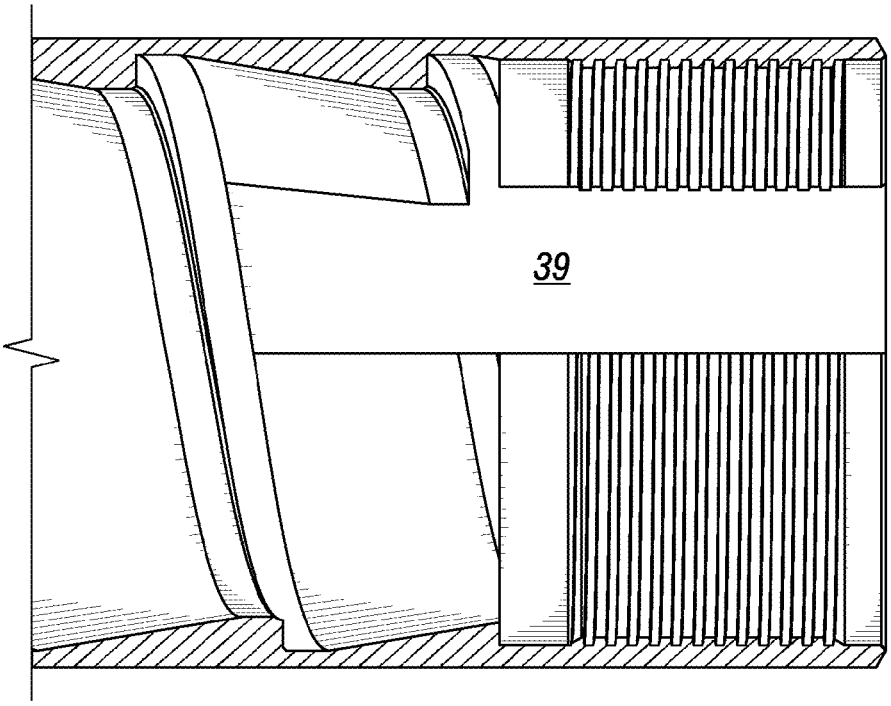
FIG. 17 illustrates an exemplary embodiment of the present invention whereby a slot has been machined through the helix and threads of a bowl.

Accordingly, referring to the exemplary embodiment of FIGS. 15, 18, 19A, and 19B, a newly designed control 40 is provided in the present invention. As shown, control 40 comprises a ring member 44 and a finger 42 extending from ring member 44. For the new design, the outer surface of finger 42 is offset (46) from the outer surface of ring member 44 in order to fit in the bowl and have a smaller OD to get past the threads on the bottom of the bowl. To get offset finger 42 past the threads, the slot that is normally machined though the helix only on prior art bowl 38 (FIG. 16), is now machined through the entire length of bowl threads 39 of the present invention (FIG. 17) in order to allow passage of the offset finger 42 during assembly. By having the slot machined through the bowl threads 39, making the OD of the control smaller, and incorporating offset finger 44, control 40 will remain in contact with the bowl and grapple at all times as illustrated in FIG. 14. As such, the offset finger 42 allows the overshot to have guide threads on the lower end of the bowl which are smaller in diameter than would otherwise be possible with prior art controls in which the finger is flush with the OD of the control.

Figure 18:
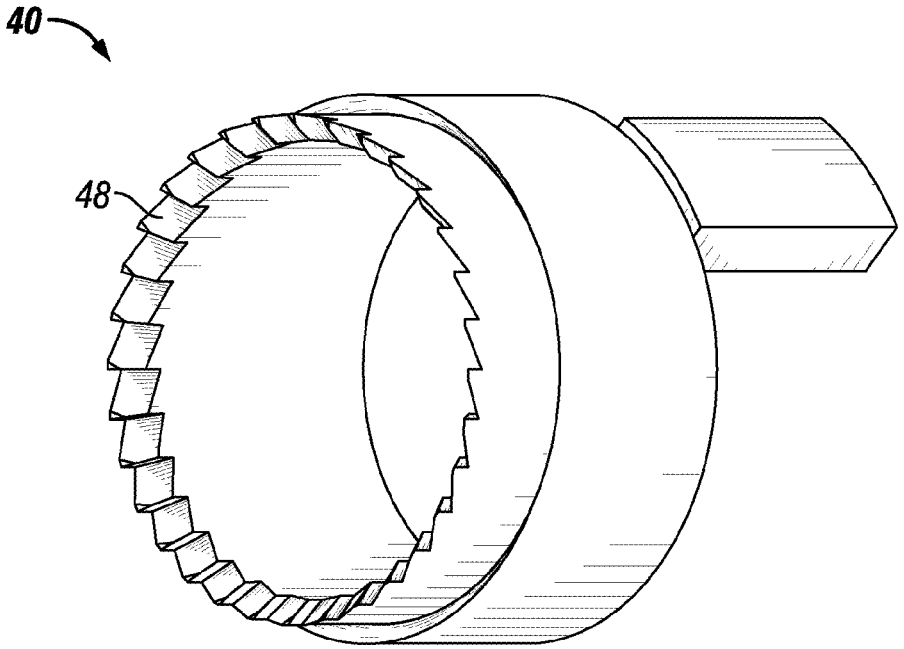
FIGS. 18, 19A & 19B illustrate alternate exemplary embodiments of an offset control finger according to the present invention.
Figure 19A:
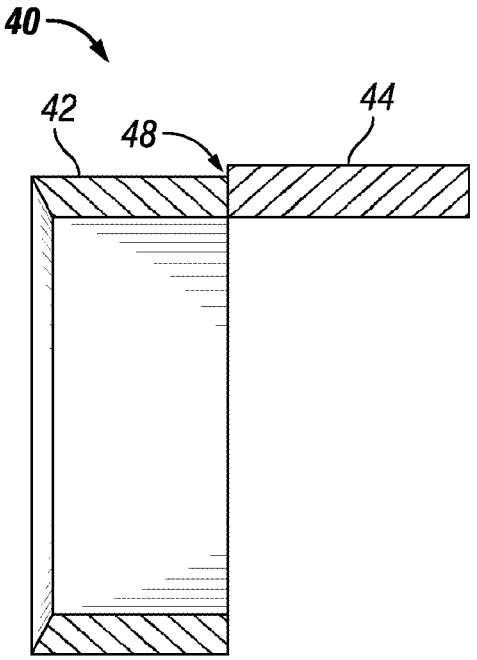
Figure 19B:
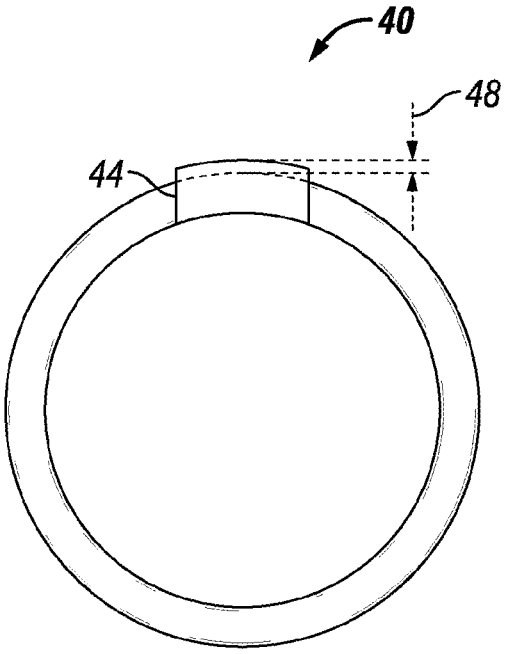

Those ordinarily skilled in the art having the benefit of this disclosure realize the described offset finger is applicable to all types of controls. FIG. 18 illustrates an exemplary control 40 having a series of cutting teeth 48. A sectional view of an offset finger according to an exemplary embodiment of present invention is also provided in FIGS. 19A & 19B. In addition, those ordinarily skilled in the art having the benefit of this disclosure realize that, although described herein in relation to a complete ring configuration, the control 40 may also comprise a partial ring member. Furthermore, the control finger may be comprised of one solid piece or composite pieces.

In yet another alternative embodiment, control 40 may have a plurality of offset fingers. For example, one offset finger may be located at a position 180 degrees from another along ring member 44. As would be understood by one ordinarily skilled in the art having the benefit of this disclosure, the grapple would have a corresponding number of control slots, and the bowl would have a corresponding number of slots machined through the threads, as previously described herein.

Figure 22:
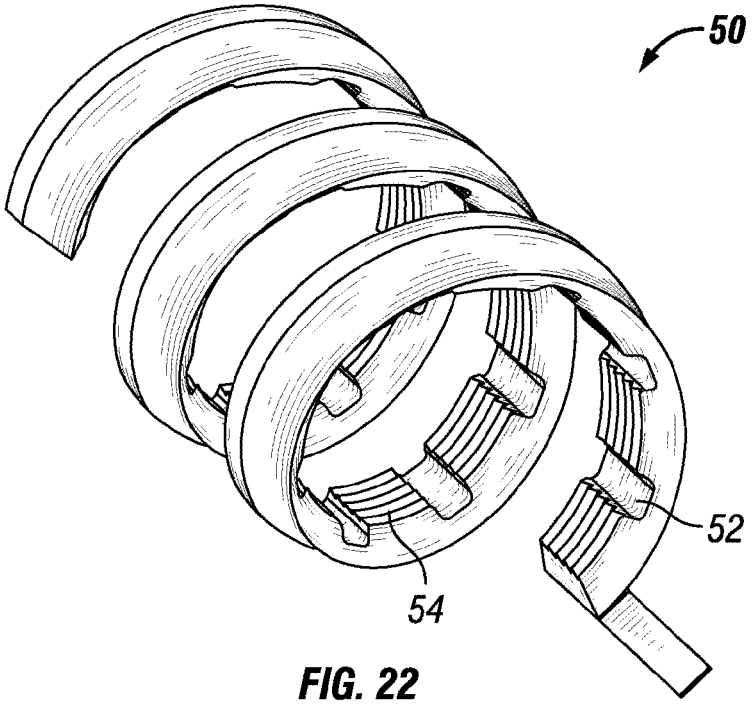
FIGS. 22 and 23 illustrate a spiral grapple according to an exemplary embodiment of the present invention.
Figure 23:
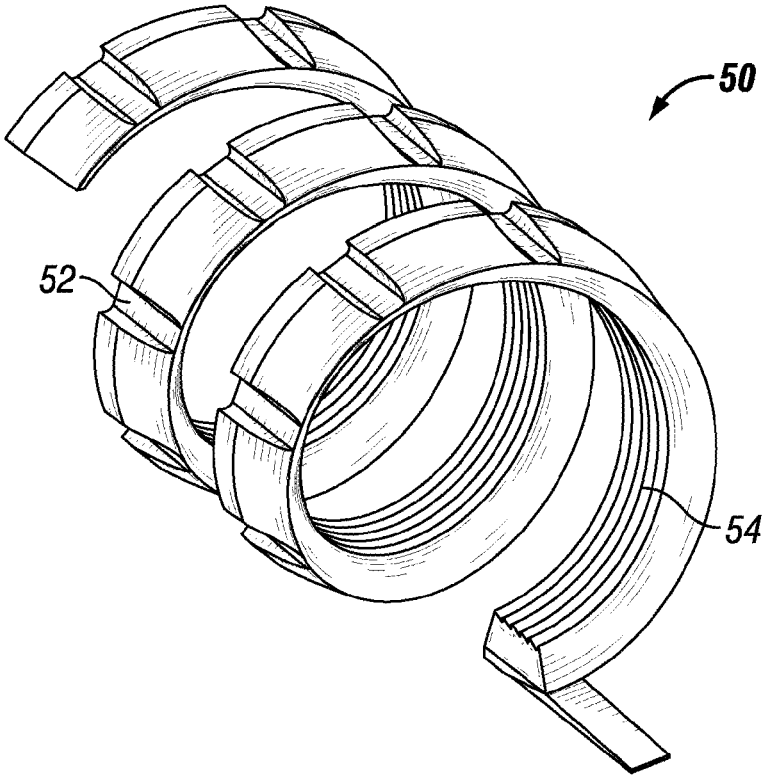
Figure 24:
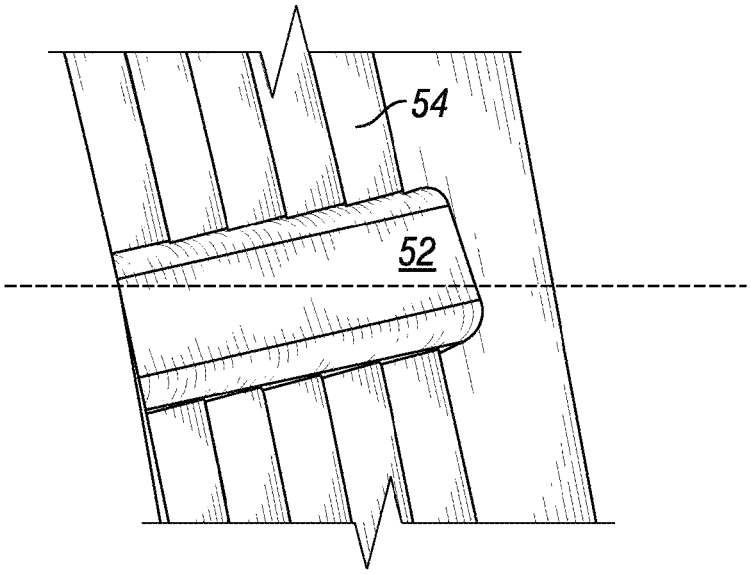
FIG. 24 illustrates a groove for use with the spiral grapple of FIGS. 22 and 23.
Figure 27:
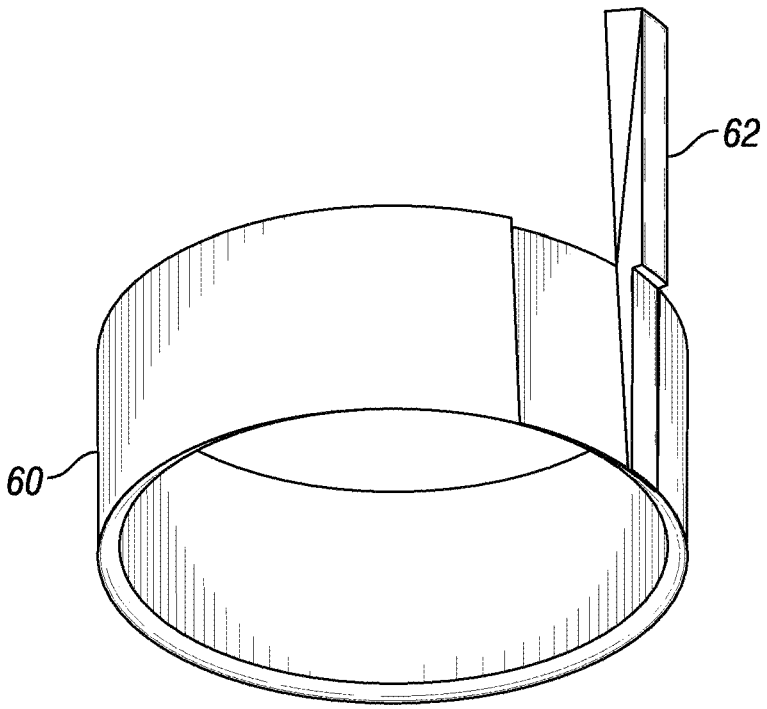
FIG. 27 illustrates a control having an offset finger for use with a spiral grapple according to an exemplary embodiment of the present invention.

An alternative embodiment of the present invention is illustrated in FIG. 22. Spiral grapple 50 may be used in the overshot to engage material that is larger than what a basket grapple is capable of engaging. As a result of designing the larger range overshot of the present invention, spiral grapple 50 has been designed with an excessively thick cross-section. When attempting to engage on the maximum size fish, the grapple 50 must expand significantly. This could potentially cause the stress on the ID to increase and cracks to appear. To reduce the cracks, grooves 52 are added to the ID or OD (FIG. 23) of grapple 50. Those ordinarily skilled in the art having the benefit of this disclosure realize the dimensions of grooves 52 and number can be varied as desired. As illustrated in FIGS. 22 and 23, grooves 52 may be cut straight down grapple 50 parallel to its axis. In the alternative, however, grooves 52 may be cut at various angles as illustrated in FIG. 24. FIG. 27 illustrates an exemplary spiral grapple control 60 having an offset finger 62 as would be understood by one ordinarily skilled in this art having the benefit of this disclosure.

Figure 25:
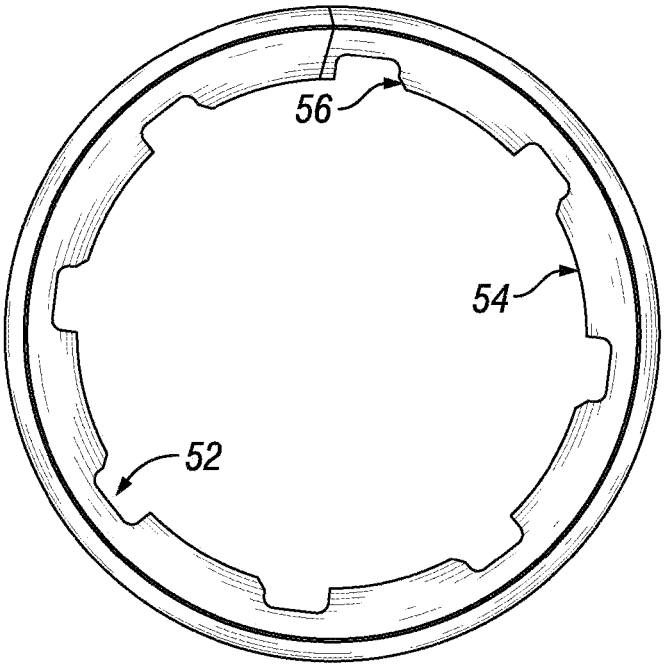
FIG. 25 illustrates a bottom-side view of a spiral grapple according to an exemplary embodiment of the present invention.
Figure 26:
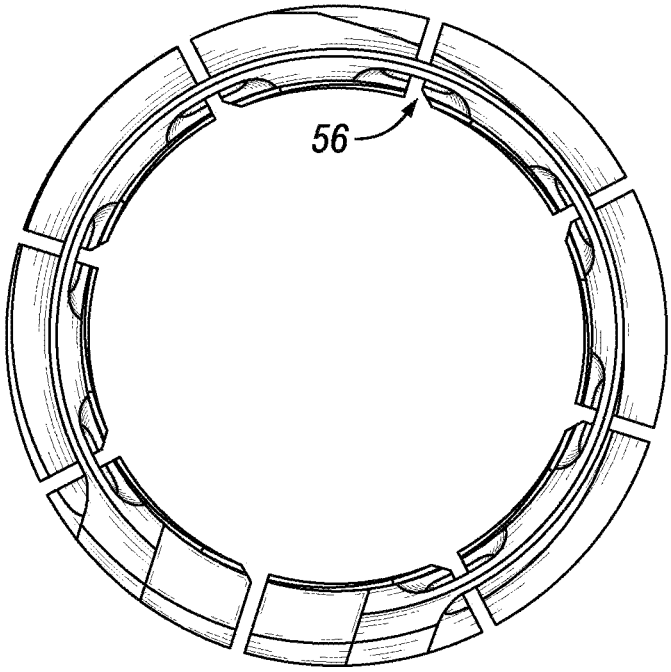
FIG. 26 illustrates a bottom-side view of a basket grapple according to an exemplary embodiment of the present invention.

FIG. 25 illustrates a bottom side view of spiral grapple 50. When a spiral grapple is rotated over a fish, there is a possibility that the edge of grooves 52 will bit into the fish. In order to alleviate this problem, this embodiment of the present invention provides a chamfered edge 56 on wicker 54 so that the leading edge of wicker 54 will not be sharp as to bite into the fish. This feature may be added to the opposite side as well, should rotating be done in the opposite direction. In addition, the chamfered edge could be utilized in basket grapples made in accordance with the present invention as illustrated in FIG. 26. Here, chamfered edge 56 is shown on the leading edge of wickers as previously discussed in relation to the spiral grapple.

An exemplary embodiment of the present invention provides an overshot comprising a bowl having a bore therethrough; a grapple placed inside the bore of the bowl, the grapple comprising a tension ring having a helix diameter and a control finger slot, wherein portions of the helix diameter adjacent both sides of the control finger slot are larger in relation to remaining portions of the helix diameter; and a plurality of segments extending from the tension ring, the overshot further including a control located within the control finger slot. In the alternative embodiment, the control comprises at least a partial ring member and a finger extending from the ring member, wherein an outer surface of the finger is offset in relation to an outer surface of the ring member. In yet another embodiment, the ring member further comprises teeth extending from the ring member in a direction opposite the finger. In yet another embodiment, the remaining portions of the helix diameter of the grapple have been reduced to a minimum helix diameter.

In another embodiment, the grapple further comprises a composite helix member coupled to the tension ring adjacent both sides of the control finger slot, thereby resulting in the larger helix diameter. In yet another exemplary embodiment, the grapple further comprises a plurality of expansion blades along an inner diameter of the tension ring. In another embodiment, the grapple further comprises a groove between adjacent expansion blades. In yet another embodiment, the bowl comprises threads having a groove extending along an entire length of the bowl threads. In another embodiment, the plurality of segments comprises a first and second edge extending along an axis of the grapple, at least one of the first or second edges comprising a chamfered edge.

An exemplary method of the present invention provides a method of using an overshot, the method comprising the steps of (a) providing a bowl having a bore therethough; (b) providing a grapple placed inside the bore of the bowl, the grapple comprising a tension ring having a helix diameter and a control finger slot, wherein portions of the helix diameter adjacent both sides of the control finger slot are larger in relation to remaining portions of the helix diameter; and a plurality of segments extending from the tension ring; (c) providing a control located within the control finger slot; and (d) using the overshot in a downhole operation. In the alternative, the control comprises a ring member and a finger extending from the ring member, step (c) further comprises the step of offsetting an outer surface of the finger in relation to an outer surface of the ring member. In yet another exemplary methodology, step (c) further comprises the step of providing teeth that extend from the ring member in a direction opposite the finger. In another methodology, step (b) further comprises the step of reducing the helix diameter to a minimum helix diameter. In yet another methodology, step (b) further comprises the step of coupling a composite helix member to the tension ring adjacent both sides of the control finger slot, thereby resulting in the larger helix diameter.

In yet another methodology, the method further comprises the step of providing a plurality of expansion blades along an inner diameter of the tension ring of the grapple. In another methodology, the method further comprises the step of providing a groove between adjacent expansion blades. In yet another methodology, the bowl comprises threads, and step (a) further comprises the step of providing a groove extending along an entire length of the threads. In another methodology, the downhole operation in step (d) is a fishing operation.

Another exemplary embodiment of the present invention provides a grapple comprising a tension ring having a helix diameter and a control finger slot, wherein portions of the helix diameter adjacent both sides of the control finger slot are larger in relation to remaining portions of the helix diameter; and a plurality of segments extending from the tension ring. In another embodiment, the remaining portions of the helix diameter have been reduced to a minimum helix diameter. In yet another embodiment, a composite helix member is coupled to the tension ring adjacent both sides of the control finger slot, thereby resulting in the larger helix diameter. In another embodiment, the grapple further comprises a plurality of expansion blades along an inner diameter of the tension ring. In yet another embodiment, the grapple further comprises a groove between adjacent expansion blades. In another embodiment, the plurality of segments comprises a first and second edge extending along an axis of the grapple, at least one of the first or second edges comprising a chamfered edge.

An exemplary methodology of the present invention provides a method of using a grapple, the method comprising the steps of (a) providing a tension ring having a helix diameter and a control finger slot, wherein portions of the helix diameter adjacent both sides of the control finger slot are larger in relation to remaining portions of the helix diameter; (b) providing a plurality of segments extending from the tension ring; and (c) utilizing the grapple in a downhole operation. In the alternative, the methodology further comprises the step of reducing the remaining portions of the helix diameter to a minimum helix diameter. In yet another exemplary methodology, the method further comprises the step of coupling a composite helix member to the tension ring adjacent both sides of the control finger slot, thereby resulting in the larger helix diameter. In another methodology, the method further comprises the step of providing a plurality of expansion blades along an inner diameter of the tension ring. In another methodology, the method further comprises the step of providing a groove between adjacent expansion blades. In yet another exemplary methodology, the downhole operation in step (c) is a fishing operation.

Yet another exemplary embodiment of the present invention provides a control comprising at least a partial ring member; and at least one finger extending from the ring member, wherein an outer surface of the at least one finger is offset in relation to an outer surface of the ring member. In another embodiment, the ring member further comprises teeth extending from the ring member in a direction opposite the at least one finger.

An exemplary methodology of the present invention provides a method of using a control, the method comprising the steps of (a) providing at least a partial ring member; and (b) providing at least one finger extending from the ring member, wherein an outer surface of the at least one finger is offset in relation to an outer surface of the ring member; and (c) utilizing the control with a grapple. In the alternative, the method further comprises the step of providing teeth which extend from the ring member in a direction opposite the at least one finger.

An exemplary embodiment of the present invention provides an overshot comprising a bowl having a bore therethrough; a spiral grapple placed inside the bore of the bowl, the spiral grapple comprising a spiral body having an inner surface and an outer surface; at least one wicker along the inner surface; and at least one groove along the spiral body, the groove extending along an axis of the grapple; and a control located within the control finger slot. In the alternative, the at least one groove is on the inner surface of the spiral body. In yet another embodiment, the at least one groove is on the outer surface of the spiral body. In another embodiment, the wicker comprises a first and second edge running along the axis of the grapple, the wicker further comprising a chamfered edge on at least one of the first or second edges.

An exemplary methodology of the present invention provides a method of using an overshot, the method comprising the steps of (a) providing a bowl having a bore therethrough; (b) providing a spiral grapple placed inside the bore of the bowl; (c) providing the spiral grapple with a spiral body having an inner surface and an outer surface; (d) providing at least one wicker along the inner surface of the spiral body; (e) providing at least one groove along the spiral body, the groove extending along an axis of the grapple; (f) providing a control located within the control finger slot; and (g) utilizing the overshot in a downhole operation. In another methodology, step (e) further comprises the step of providing the at least one groove on the inner surface of the spiral body. In yet another methodology, step (e) further comprises the step of providing the at least one groove on the outer surface of the spiral body. In another methodology, the wicker comprises a first and second edge running along the axis of the grapple, step (d) further comprises the step of providing a chamfered edge on at least one of the first or second edges.

Another exemplary embodiment of the present invention provides a spiral grapple comprising a spiral body having an inner surface and an outer surface; at least one wicker along the inner surface; and at least one groove along the spiral body, the groove extending along an axis of the grapple. In another embodiment, the groove is on the inner surface of the spiral body. In yet another embodiment, the groove is on the outer surface of the spiral body. In yet another embodiment, the wicker comprises a first and second edge running along the axis of the grapple, the wicker further comprising a chamfered edge on at least one of the first or second edges.

Another exemplary methodology of the present invention provides a method of using a spiral grapple, the method comprising the steps of (a) providing a spiral body having an inner surface and an outer surface; (b) providing at least one wicker along the inner surface; (c) providing at least one groove along the spiral body, the groove extending along an axis of the grapple; and (d) utilizing the grapple in a downhole operation. In another methodology, step (c) further comprises the step of providing the groove on the inner surface of the spiral body. In yet another methodology, step (c) further comprises the step of providing the groove on the outer surface of the spiral body. In another methodology, the wicker comprises a first and second edge running along the axis of the grapple, step (b) further comprising the step of providing the wicker with a chamfered edge on at least one of the first or second edges. In yet another methodology, the downhole operation in step (d) is a fishing operation.

Figure 28:
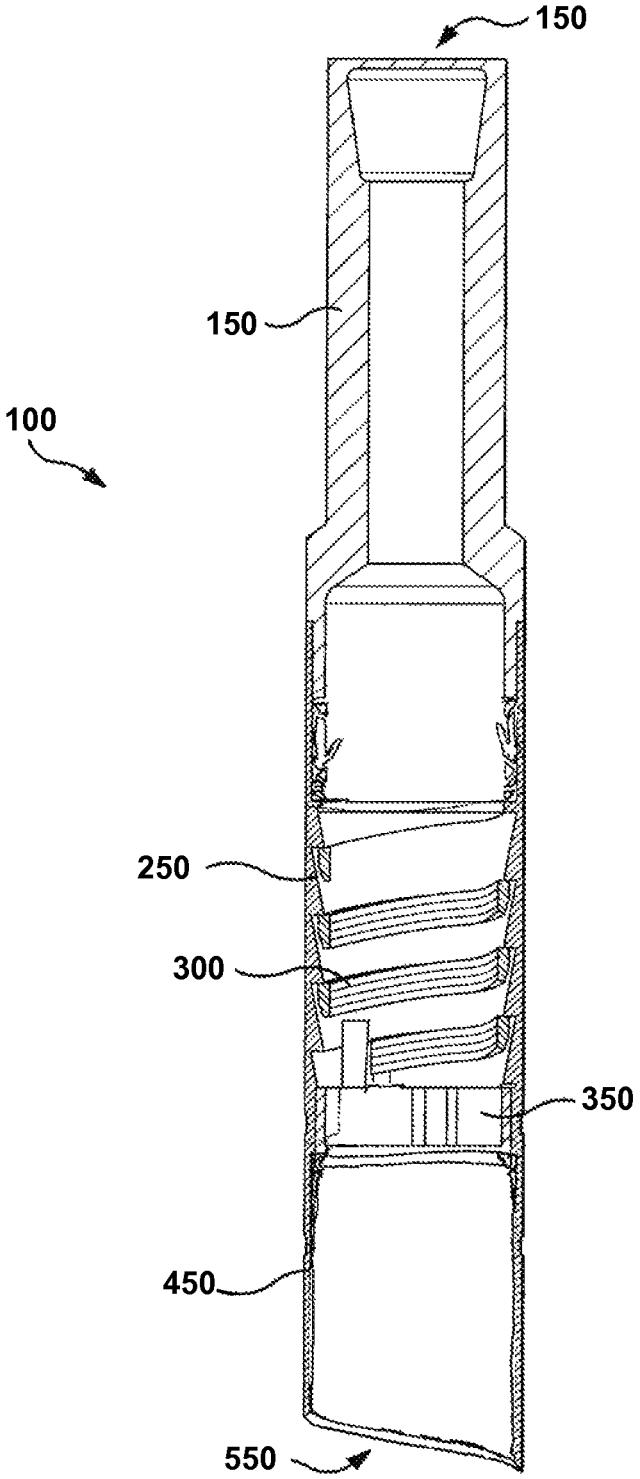
FIG. 28 is a view of a fishing tool according to one or more aspects of the present disclosure.

FIG. 28 is a cross sectional view of an external catch fishing tool 100. The fishing tool 100 may be lowered in a borehole drilled through the Earth's crest at the end of a drill string (not shown) connected to the fishing tool 100 at an upper end 500 thereof. The fishing tool 100 is to be engaged with a fish (not shown) at a lower end 550 thereof. During the engagement with the fish, the fishing tool 100 is rotated clockwise and lowered, expanding gripping parts provided inside the fishing tool 100 and allowing the fish to enter the fishing tool 100. After the fish is engaged, rotation is ceased and an upward pull force is exerted on the fishing tool 100, causing the gripping parts inside the fishing tool 100 to contract and the fishing tool 100 to grip the fish firmly. For releasing the fish, a sharp downward acceleration releases the contraction of the gripping parts on the fish, breaking the grip. Thereafter, the fishing tool 100 is rotated clockwise and slowly elevated, screwing the gripping parts off the fish. The fact that the fishing tool 100 is operated clockwise for engaging and releasing the fish may reduce the risks encountered when rotating the drill string counterclockwise.

In the example of FIG. 28, the fishing tool 100 comprises three external parts: a top sub 150, a bowl 250, and a guide 450. The bowl 250 includes a helically tapered spiral section in its inside diameter. The fishing tool 100 may be dressed with either of two sets of gripping parts, either a spiral grapple or a basket grapple, depending on whether the fish to be caught is near maximum catch size. For example, if the fish diameter is near the maximum catch, a spiral grapple 300 and grapple control 350 may be used. The spiral grapple 300 is formed as a left-hand helix with a tapered exterior that conforms to the helically tapered section in the inside diameter of the bowl 250. The inner diameter of the spiral grapple 300 is usually provided with wickers (not shown) for engagement with the fish.

Figure 29:
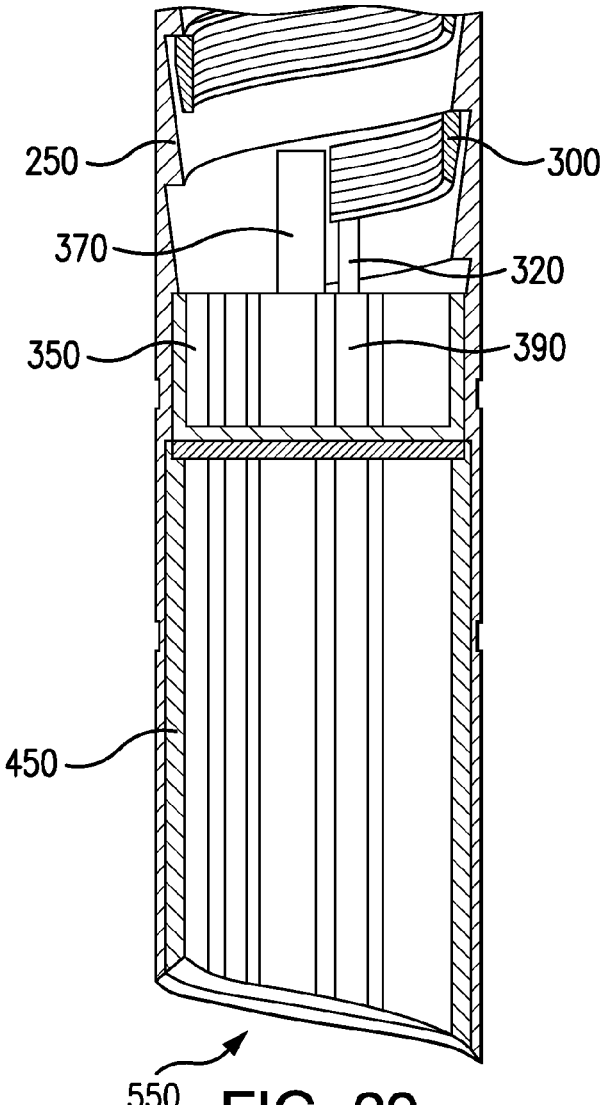
FIG. 29 is a view of a portion of the fishing tool shown in FIG. 28.

Referring to the sectional views of FIGS. 28 and 29, the grapple control 350 allows the spiral grapple 300 to move up and down in the bowl 250 during operation of the fishing tool 100 while simultaneously transmitting torque from the spiral grapple 300 to the bowl 250. In this example, the spiral grapple 300 comprises a key 320 that engages a corresponding groove 390 on the outer diameter of the grapple control 350. In addition, the grapple control 350 comprises a key 370 that engages the outer diameter of the spiral grapple 300. Keys 320 and 370 engage and may slide along a longitudinal groove on the inner diameter of the bowl 250 (not shown). The back up ring in FIGS. 28 and 29 is similar to the one shown in FIG. 31.

After engaging the fish with the spiral grapple 300, the spiral grapple 300 moves down the bowl 250, the tapers along the grapple outer diameter slide along the ones along the bowl inner diameter, in some cases over a large distance. As a result, the key 320 of the grapple 300 compresses axially towards the inner diameter of the tool. The key 320 may come into contact with and press against the surface of the groove 390 on the grapple control 350. Also, as a substantially large upward pull force is exerted on the fishing tool 100, and the spiral grapple 300 bites into the fish, the spiral grapple 300 moves even further down the bowl 250, possibly increasing the contact force between the key 320 and the grapple control 350. An excessive level of contact force may cause the spiral grapple 300, the key 320, the grapple control 350, or the bowl 250 to fail.

Figure 32:
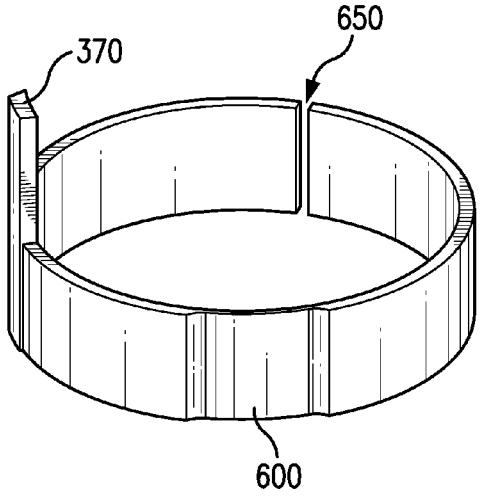
FIG. 32 is a view of a stress reducing, deflecting spiral grapple control according to one or more aspects of the present disclosure.
Figure 33:
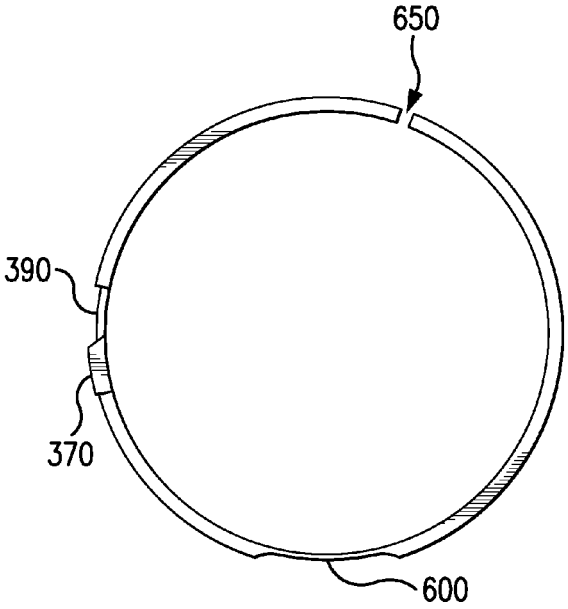
FIG. 33 is another view of the stress reducing, deflecting spiral grapple control shown in FIG. 5.

As best shown in perspective and top views of FIGS. 32 and 33, respectively, the ring portion of the grapple control 350 is provided with a gap 650 to make the grapple control 350 more compliant and reduce the contact force between the key 320 and the grapple control 350. The gap 650 may be located and sized to promote the deflection of the grapple control 350 as the key 320 presses on the surface of the groove 390. The gap 650 may also be located and sized to close without causing the two ends on either sides of the gap 650 to overlap. For example, the gap may be between about 90 degrees and 135 degrees apart from the groove 390. In addition, a bridge 600 having a reduced thickness is provided on the grapple control 350. The bridge 600 may be located and sized to reduce the stress level in the grapple control 350 as the gap 650 closes. For example, the thickness at the bridge may be reduced by at least one half of the thickness in the rest of the grapple control 350. The bridge may span an arc of varying sizes. For example, the bridge may span an arc of about 10 degrees. The bridge 600 may be essentially opposite the gap 650 with respect to a diameter line passing through the groove 390.

The gap 650 may be of varying width and angle relative to the axis and outer diameter surface of the grapple control 350. The gap 650 may be located and sized to allow the grapple control 350 to deform under any load it may be subjected to, including by the key 320 or other portion of the spiral grapple 300. Depending on its width, the gap 650 may close completely or partially. While the angular position of the gap 650 relative to the groove 390 is variable, the angular position is preferably selected such that as the grapple control 350 is compressed, the cut faces across the gap 650 do not hinder sliding of the grapple control 350 into the bowl 250, or proper engagement of the spiral grapple 300 with the fish.

The compression of the grapple control 600 may be attenuated with the addition of multiple bridges similar to bridge 600. The locations of the bridges and the quantity of material machined out of the grapple control may be selected to reduce the stress level or obtain a suitable deformed shape of the grapple control. Other embodiments of the present disclosure also include a grapple control with two or more gaps and support bands, and may not include bridges. In yet other embodiments of the present disclosure, the grapple control may be provided with alternate upward and downward cuts which may also make the grapple control more compliant without machining bridges.

Figure 30:
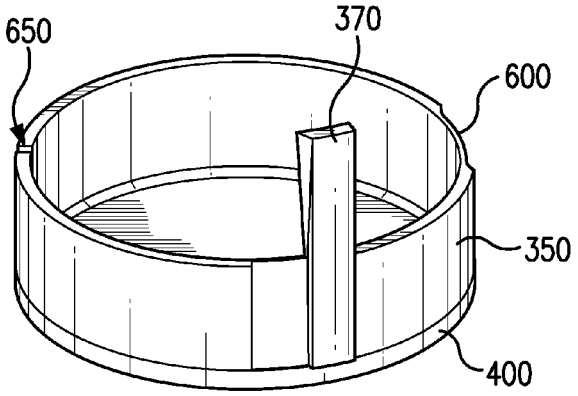
FIG. 30 is a view of a spiral grapple control and back-up ring according to one or more aspects of the present disclosure.
Figure 31:
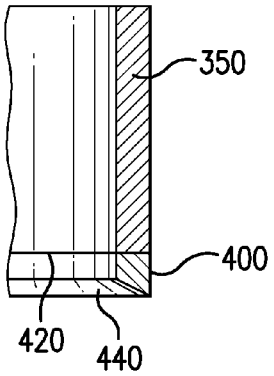
FIG. 31 is a view of a portion of the spiral grapple control and back-up ring shown in FIG. 30.

As shown in perspective and sectional views of FIGS. 30 and 31, respectively, a backup ring 400 may be provided at the base of the grapple control so that it is situated between the grapple control 350 and the guide 450 to give the grapple control 350 a face on which to slide. The backup ring 400 may have a bevel 440 that enables the fish to enter the fishing tool easily. The backup ring 400 may further facilitate the deflection of the grapple control 350 by eliminating the misalignment of the grapple control 350 with a support shoulder provided by the guide 450. Indeed, the backup ring 400 has a flat, smooth face 420 that pairs with a corresponding flat, smooth face of the grapple control 350. This face to face contact may allow relative movement, sliding for example, between the grapple control 350 and the backup ring 400 as the grapple control 350 is being deformed. While a flat face to face contact is shown in FIG. 31, the contact plane between the backup ring 400 and the grapple control 350 may be angled, for example to affect the load needed to deform the grapple control 350. Also, the contact surface between the backup ring 400 and the grapple control 350 may be comprised of several segments at different angles, for example to maintain the grapple control 35 centered or to insure its even deflection. That is the grapple control (or the backup ring) may comprise at least two segments that have contact with the backup ring (or with the grapple control respectively) at different angles. The backup ring may also be omitted if the guide 45 provides a flat face for the grapple control to slide upon.

By providing the gap 650 and the bridge 600 to allow the grapple control 350 to deflect when the key 320 of the spiral grapple 300 contacts the grapple control 350, mechanical failure of the spiral grapple 300, the key 320, the grapple control 350, or the bowl 250 may be delayed or eliminated. Indeed, as the fishing tool 100 is pulled and the spiral grapple 300 slides down in the bowl 250, the key 320 may first come into contact with the outer surface of the grapple control 350. Then, as the pulling load on the fishing tool increases, the grapple control 350 may deflect without excessive resistance, partially closing the gap 650. The deflection of the grapple control 350 may reduce the stress level in the area of contact between the key 320 and the grapple control 350, at least until the gap 650 is completely closed.

In view of all of the above and the figures, those skilled in the art should readily recognize that the present disclosure introduces a fishing tool comprising a spiral grapple and a grapple control each having a key for sliding engagement with a bowl groove, wherein a cut is provided on the grapple control. The grapple control may further include a bridge of reduced thickness.

The present disclosure also introduces a fishing method comprising engaging a fish into a spiral grapple, allowing the spiral grapple to move down a bowl, transmitting torque between the spiral grapple and the bowl using a grapple control, and deforming the grapple control with the spiral grapple.

Although various embodiments have been shown and described, the invention is not limited to such embodiments and will be understood to include all modifications and variations as would be apparent to one skilled in the art. For example, those ordinarily skilled in the art having the benefit of this disclosure realize the embodiments of the present invention may be combined or utilized separately. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. An overshot comprising:

a bowl having a bore therethrough;

a spiral grapple placed inside the bore of the bowl, the grapple comprising a grapple key;

a grapple control comprising a ring member having an inner diameter and an outer diameter, at least one gap, and at least one bridge, wherein said bridge has a reduced outer diameter than said outer diameter of said ring member, and a finger extending from the ring member, for engaging said spiral grapple; and a guide, wherein, when in use, the grapple control is deformed and said deforming is allowed for by the gap.

2. The overshot of claim 1, wherein the grapple control further comprises a backup ring between the grapple control and the guide of the overshot.

3. The overshot of claim 2, wherein a plane of contact between the backup ring and the grapple control is angled.

4. An improved overshot comprising a bowl, a spiral grapple having a grapple key, a grapple control comprising a ring member and a finger for engaging the spiral grapple and a guide, wherein the improvement comprises at least one gap in the ring member of the grapple control such that, when in use, the grapple control is deformed and said deforming is allowed for by the gap.

5. The improved overshot of claim 4, wherein the improvement further comprises a bridge in the grapple control, wherein the bridge has a reduced thickness as compared to the thickness of the grapple control.

6. The improved overshot of claim 4, wherein the improvement further comprises a backup ring on the base of the grapple control.

7. The improved overshot of claim 6, wherein a plane of contact between the backup ring and the grapple control is angled.

8. The improved overshot of claim 6, wherein a contact surface between the backup ring and the grapple control comprises a plurality of segments, wherein the plane of contact between the backup ring and the grapple control for at least two segments are at different angles relative to one another.

9. A fishing method comprising the steps of:

engaging a fish into a spiral grapple having a grapple key, allowing the spiral grapple to move down a bowl, transmitting torque between the spiral grapple and the bowl using a grapple control, and deforming the grapple control with the spiral grapple wherein said grapple control comprises a gap and said deforming of the grapple control is allowed for by the gap.

* * * * *